US007284353B2

(12) United States Patent
Bealko

(10) Patent No.: US 7,284,353 B2
(45) Date of Patent: Oct. 23, 2007

(54) WINDOW AND DOOR CASING

(75) Inventor: Donald J. Bealko, Bedford, NH (US)

(73) Assignee: Riverside Millwork Co., Inc., Penacook, NH (US)

( * ) Notice: Subject to any disclaimer, the term of this patent is extended or adjusted under 35 U.S.C. 154(b) by 192 days.

(21) Appl. No.: 10/925,342

(22) Filed: Aug. 24, 2004

(65) Prior Publication Data

US 2005/0034388 A1 Feb. 17, 2005

Related U.S. Application Data

(63) Continuation-in-part of application No. 10/287,962, filed on Nov. 5, 2002, now Pat. No. 6,857,232.

(51) Int. Cl.
*E06B 1/04* (2006.01)

(52) U.S. Cl. ..... 52/656.5; 52/717.01

(58) Field of Classification Search ..... 52/211, 52/212, 204.53, 204.54, 204.55, 204.6, 204.7, 52/204.705, 204.5, 656.4, 656.5, 656.2, 656.3, 52/656.6, 707.01, 734.1
See application file for complete search history.

(56) References Cited

U.S. PATENT DOCUMENTS

| | | | | |
|---|---|---|---|---|
| 3,220,062 | A | 11/1965 | Hermann | |
| 4,193,238 | A | 3/1980 | Chalmers et al. | 52/211 |
| 4,280,309 | A | 7/1981 | Huelsekopf | 52/212 |
| 4,389,824 | A | 6/1983 | Anderson | 52/211 |
| 4,407,100 | A | 10/1983 | Huelsekopf | 52/212 |
| 4,428,156 | A | 1/1984 | Malm et al. | 49/501 |
| 4,457,110 | A | 7/1984 | Beirnes | 49/419 |
| 4,516,356 | A | 5/1985 | Delman | 49/504 |
| 4,550,540 | A | 11/1985 | Thorn | 52/309 |
| 4,563,846 | A | 1/1986 | Webb | 52/208 |
| 4,624,091 | A | 11/1986 | Biro | 52/656 |
| 4,747,248 | A | 5/1988 | Fahs | 52/455 |
| 4,831,804 | A * | 5/1989 | Sayer | 52/656.5 |
| 4,972,640 | A | 11/1990 | DiFazio | 52/211 |
| 5,022,204 | A | 6/1991 | Anderson | 52/211 |
| 5,222,343 | A | 6/1993 | Anderson | 52/718.04 |
| 5,257,488 | A | 11/1993 | Candusso | 52/212 |
| 5,303,522 | A * | 4/1994 | Vagedes | 52/209 |
| 5,537,789 | A | 7/1996 | Minke et al. | 52/313 |
| 5,570,548 | A | 11/1996 | Hopper | 52/204.5 |
| 5,572,840 | A | 11/1996 | Fast et al. | 52/213 |
| 5,577,355 | A | 11/1996 | Leonelli | 52/204.62 |
| 5,625,992 | A | 5/1997 | Strick et al. | 52/656.9 |
| 5,647,172 | A | 7/1997 | Rokicki | 49/504 |
| 5,660,010 | A | 8/1997 | Sayers | 52/217 |
| 5,669,192 | A | 9/1997 | Opdyke et al. | 52/211 |
| 5,758,458 | A | 6/1998 | Ridge | 52/204.1 |
| 5,779,384 | A | 7/1998 | Olsen | 403/231 |
| 5,857,299 | A | 1/1999 | Gyllenberg et al. | 52/217 |
| RE36,240 | E | 6/1999 | Minke et al. | 52/313 |
| 5,932,314 | A | 8/1999 | West | 428/151 |
| 5,948,849 | A | 9/1999 | Porter | 524/506 |
| 6,024,908 | A | 2/2000 | Koncelik | 264/333.11 |
| 6,055,782 | A | 5/2000 | Morton et al. | 52/204.1 |
| 6,092,343 | A | 7/2000 | West et al. | 52/309.11 |
| 6,098,368 | A | 8/2000 | McKann | 52/784.13 |
| 6,120,852 | A | 9/2000 | Porter | 427/417 |
| 6,243,999 | B1 | 6/2001 | Silverman | 52/204.51 |

* cited by examiner

*Primary Examiner*—Michael Safavi
(74) *Attorney, Agent, or Firm*—Hayes Soloway PC

(57) ABSTRACT

A window or door casing may have two side sections, a header or top section, and a bottom section. The bottom section also may have caps attached at either end. The trim casing is mountable on a window or door frame and cab be securely fastened to the side of the house ensuring a tight fit and finished appearance.

26 Claims, 18 Drawing Sheets

WINDOW AND DOOR CASING

CROSS-REFERENCE TO RELATED APPLICATION

This application is a continuation-in-part application of U.S. application entitled, "Window and Door Casing" Ser. No. 10/287,962 filed Nov. 5, 2002 now U.S. Pat. No. 6,857,232, which is entirely incorporated herein by reference.

FIELD OF THE INVENTION

The present invention is generally related to window and door casing, and more particularly is related to trim for window and door casings.

BACKGROUND OF THE INVENTION

The use of vinyl siding in place of wood, aluminum, or other materials on the exterior of a house has become quite prevalent in new construction as well as remodeling. Such siding historically has been made of aluminum or wood. Window and door openings in the exterior wall of a house are generally trimmed with wood casings or moldings framing the window, providing an aesthetically finished exterior look. One version of such a window trim has been the "Eastern" casing. Typically, the window manufacturer attaches a board about 3-4 inches wide that is about ¾ to 5/4 inches thick to the face of the window jamb and ships the window with this feature applied.

Alternatively, the builder constructs the wood casing at the site. The house siding, whether wood or vinyl, is fitted to or butted up against the trim casing. In the case of vinyl siding, a "J" channel is nailed to the wallboard and the vinyl siding slides behind the face of the J channel. One problem with this, however, is that the wooden casings are not compatible with aluminum or vinyl siding. For example, the wood requires continuous painting, defeating the maintenance-free advantages of vinyl siding, the appearance is inconsistent, and wood against vinyl creates the potential for unsightly gaps because of their different thermal characteristics.

U.S. Pat. No. 4,193,238 describes a window casing cover comprised of trim molding members that snap onto a plurality of separate brackets that are individually attached to the original casing. Although the cover provides a maintenance free surface, the numerous components involved and the "do it yourself" appearance of the add-on side portions and coverings do not offer the structure and strength or appearance of an integrated component, nor is the problem of differing thermal expansion/contraction resolved.

U.S. Pat. No. 4,389,824 discloses window trim comprised of upper and side panels and a window sill covering. Each panel has a receiving strip, which is fitted around the inside of the window casing, and a substantially flat panel is bent at the site into an L-shaped configuration, which is then fitted around the casing and overlies the siding. The receiving strip includes a spring-held receiving slot for the L-shaped panel. U.S. Pat. No. 5,022,204 discloses a similar receiving strip and L-shaped facing strip in which the receiving strip may be attached to the front of the casing. Both of these approaches are time consuming to fabricate and install, are comprised of many components having different angles and fittings, and include the cumbersome method of using L-hooks screwed into the house to hold and align the strips.

A do-it-yourself kit of prefabricated components for retrofitting cladding over an existing door or window frame is disclosed in U.S. Pat. No. 5,669,192. The kit comprises sections for covering the side and the header surfaces of the existing trim. A lengthwise lip folds inward along one edge of each section and a lengthwise flange portion folds inward around the opposite edge of each such section, gripping the trim in frictional engagement. A J-strip exists around the frame to retain the siding and the folded flange fitting between the J-strip and the siding. A drawback of this approach is that the use of friction to hold the cladding in place lacks stability and durability and will result in an inconsistent fit and appearance over time.

With the introduction of the vinyl window, an Eastern casing trim option had not been available in an extruded vinyl add-on. Accordingly, builders desiring the aesthetics of an Eastern casing were relegated to using wood and/or wood wrapped in aluminum cladding that requires custom fitting, a labor intensive and expensive process. Thus, a heretofore, unaddressed need exists in the industry to address the aforementioned deficiencies and inadequacies.

SUMMARY OF THE INVENTION

Embodiments of the invention provide a window and door casing for use with new construction as well as remodeling that is simple to fit and install. The casing provides a durable, secure and complete aesthetic finished look, and will not be subject to differing thermal characteristics. The trim casing is comprised of extruded portions or sections with an integral "J" channel built in, providing superior aesthetic features; two side sections, a header or top section, and in the case of a window application, a sill bottom section. The sill also has caps attached at either end. The trim casing is mountable on a window or door frame and is securely fastened to the side of the house ensuring a tight fit.

In one embodiment, the casing is comprised of extruded vinyl, and comprises pre-mitered side sections and the header section. The casing includes a rapid fastening system incorporating a screw boss in the extrusion coupled with a tongue-in-groove design on the inside edge. A tongue extends from the rear portion and may also have a nailing fin on the rear portion extending opposite the tongue. The tongue is received by an accessory groove (channel) with a flexing accessory lock incorporated on the sides of the window or door frame. In the case of a window casing, an extruded attachable sill nosing may be incorporated. The sill nosing simulates the thick wood look and may have insertable end caps to cover the open ends. The sill nosing may also incorporate an integral flange to cover the meeting point of the side casing to the sill nosing.

A method of installing the casing consistent with the invention is also disclosed. In the case of new construction, the window or door is leveled and squared properly. The window or door is secured by nails, staples, or screws using the window's or door's nailing fin. The pre-mitered top section and pre-mitered side casing are pre-assembled by mating the angled ends thereof and then screwing the sections together. The partially assembled top section and side casing result in a three-sided "horseshoe" shaped assembly. The "horseshoe" shaped assembly is slid over the front of the window or door. The tongues of the assembly fit into the accessory grooves located on the forward facing surface of the window or door frame. Next, the tongue or flange of the sill section is placed into the accessory groove on the bottom end of the window and snapped into place using a mallet to tap the tongues into the accessory grove to ensure a snug fit. The side sections are also fitted behind the flange at the meeting point of the side sections to the sill section. The end caps may also be fitted into the sides of the sill section. The sill section is then fastened to the side sections with screws and the casing is secured to the side of the house with nails using the attached nailing fins.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
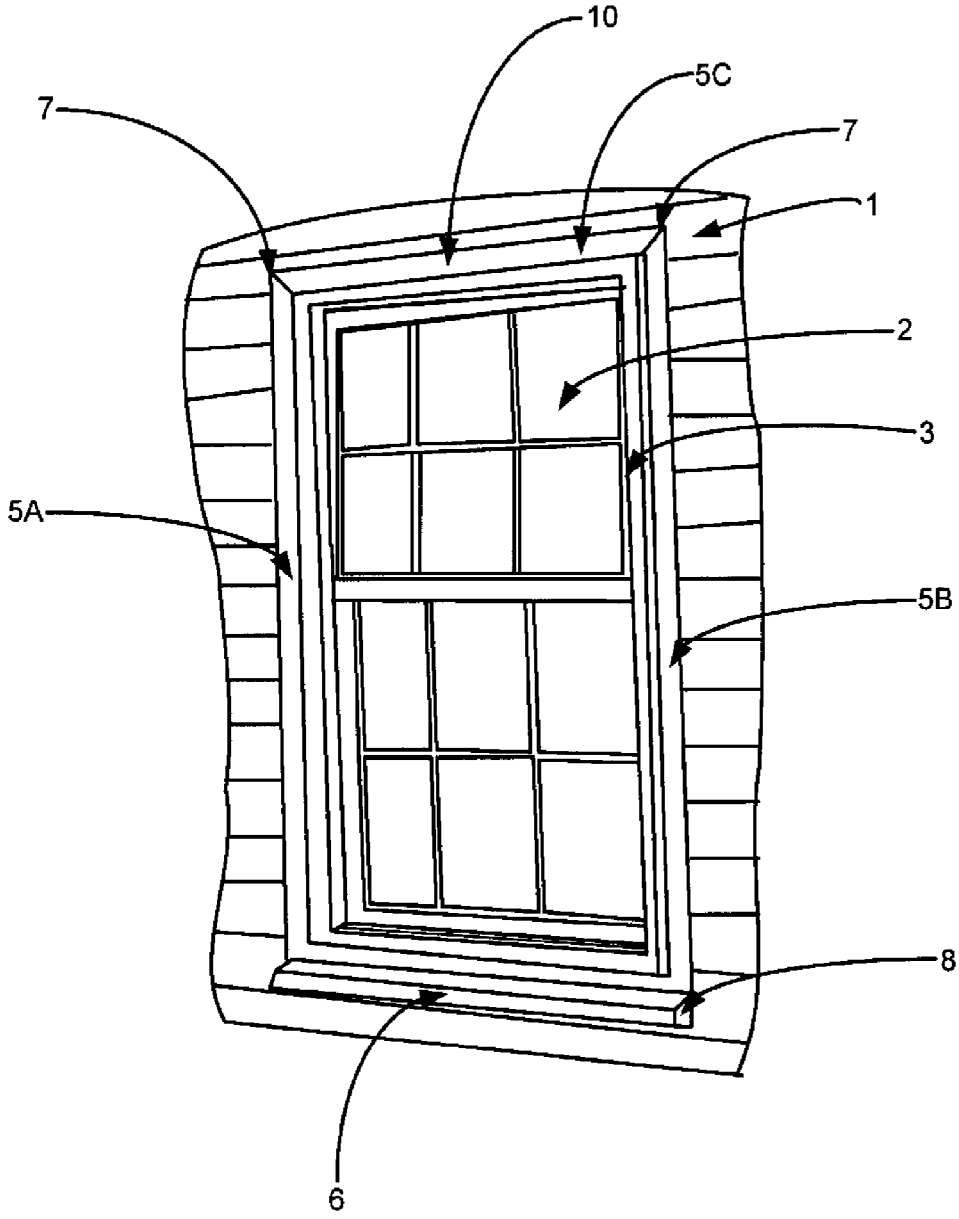
FIG. 1 is a perspective view of a window of a house and includes the casing according to the present invention.
Figure 2:
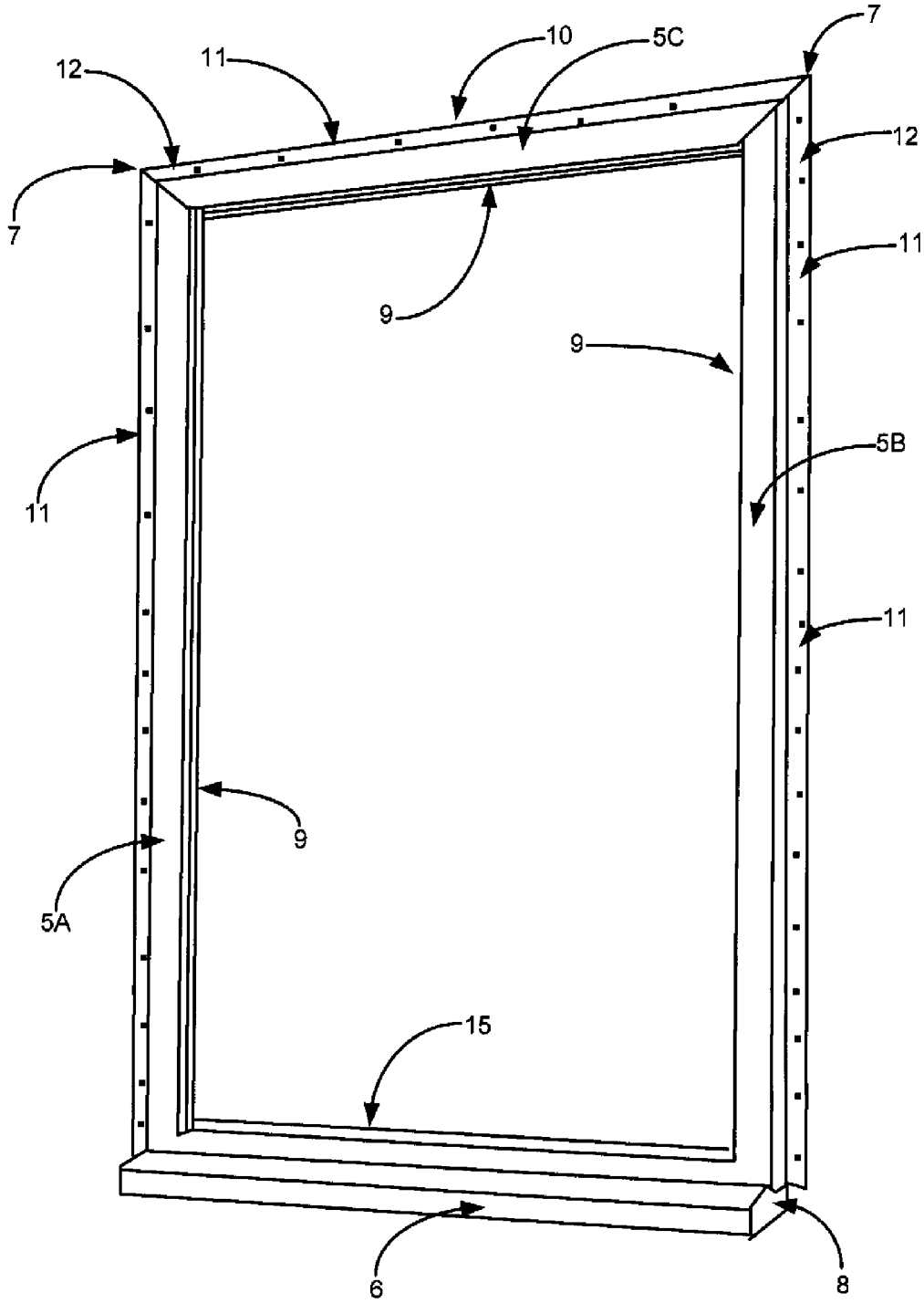
FIG. 2 is a perspective view of the assembled casing according to the invention.

Referring to FIG. 1, a first exemplary embodiment is shown of an eastern casing 10 mounted on the window frame 3 of a window 2 installed on a house. In FIG. 2 the assembled casing 10 is shown independent of the window or house. In the first exemplary embodiment, the casing 10 comprises two side sections 5*a* and 5*b*, header or top section 5*c*, and sill or bottom section 6. The sill section 6 may have end caps 8 attached at either end of the sill 6. The sections of the casing may be pre-cut for standard sized windows or may be custom cut in advance or at the site, for non-standard sized windows. The casing 10 can be comprised of extruded vinyl or other materials such as aluminum. The top corners of side sections 5*a* and 5*b* are pre-mitered at 45° angles and meet flush with the ends of the top section 5*c*, which are also pre-mitered at 45° angles at the corners 7. It is appreciated that the mitered angles of the top and side sections may vary from 0-90° depending upon the aesthetic look desired or to combine with decorative caps or millwork. It should be understood that the casing described herein can be used in trimming a door or other opening.

Figure 5B:
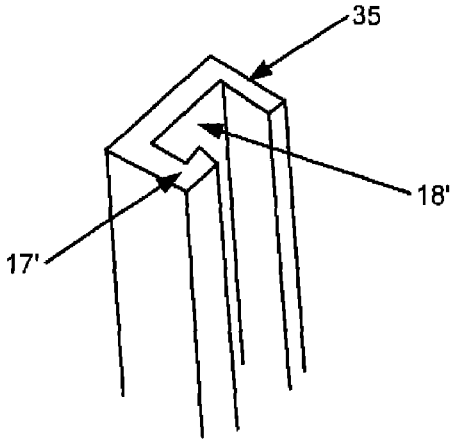
FIG. 5B is a fragmentary perspective view of an add-on accessory groove device.
Figure 5:
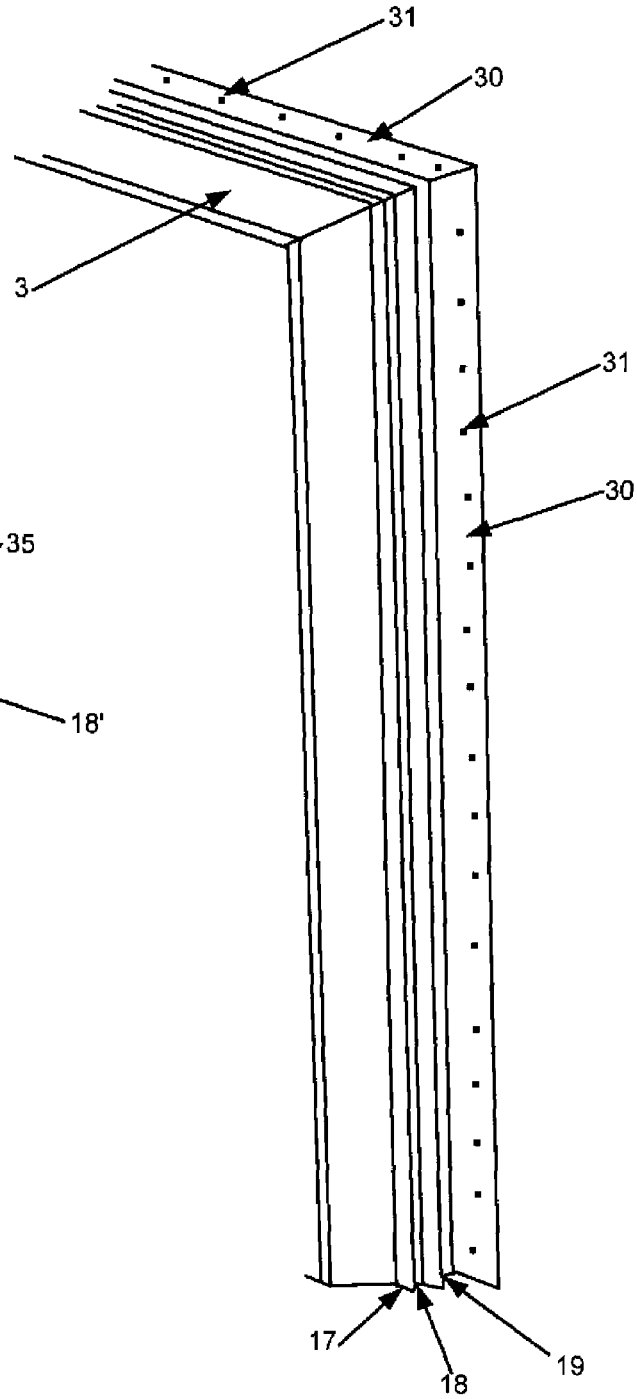
FIG. 5A is a perspective view of two sides of a window frame according to the present invention.
Figure 8A:
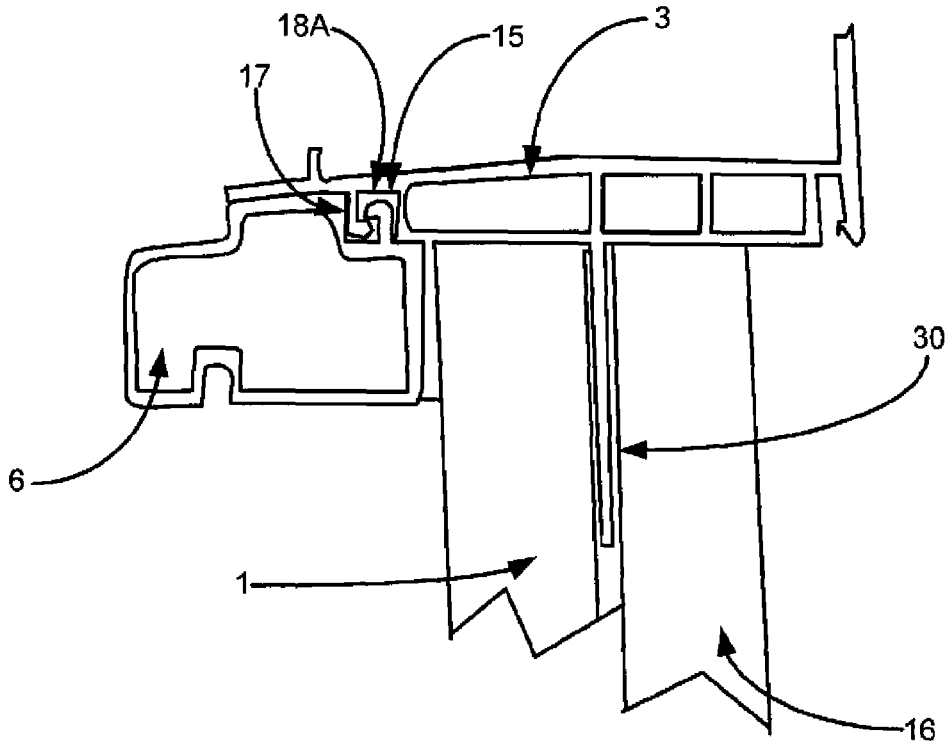
FIG. 8A is a side view of a sill mounted on the bottom of a window frame installed on a house showing the exterior siding, in accordance with a first embodiment.
Figure 8B:
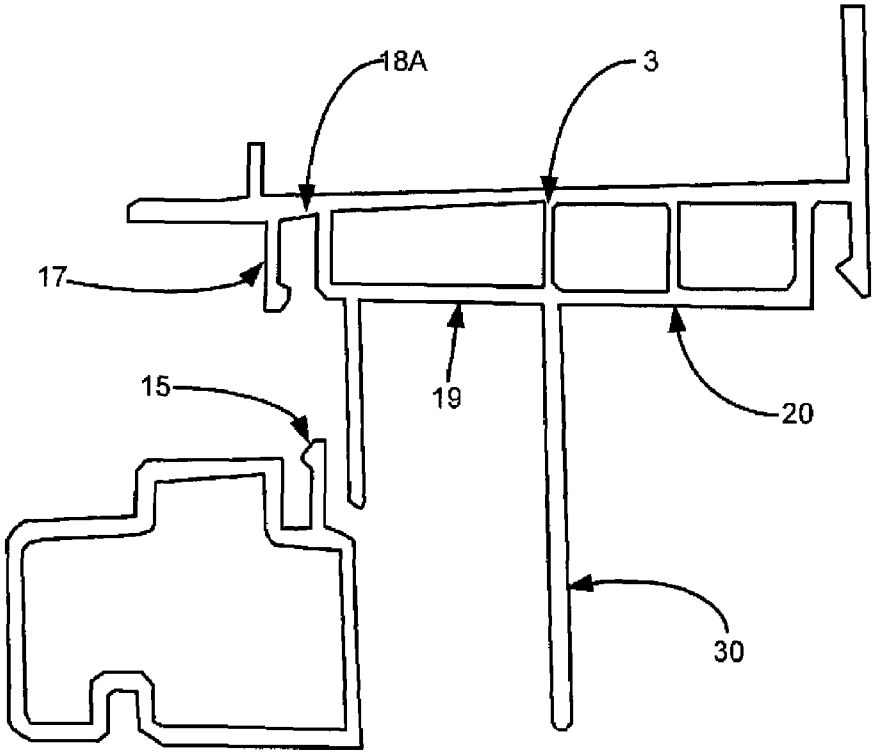
FIG. 8B is an exploded side view of a sill and the bottom of a window frame, in accordance with the first embodiment.
Figure 9:
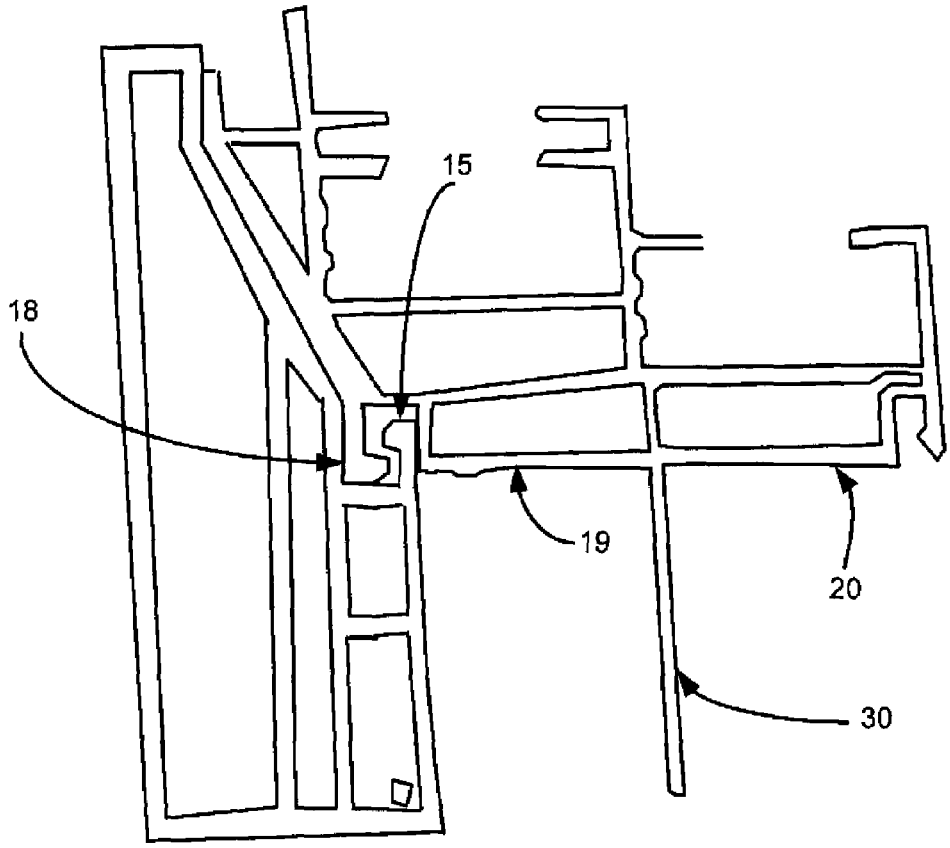
FIG. 9 is a top planar view of a second example of the side casing section mounted on the side of the window frame installed on a house showing the exterior siding, in accordance with a first embodiment.
Figure 10A:
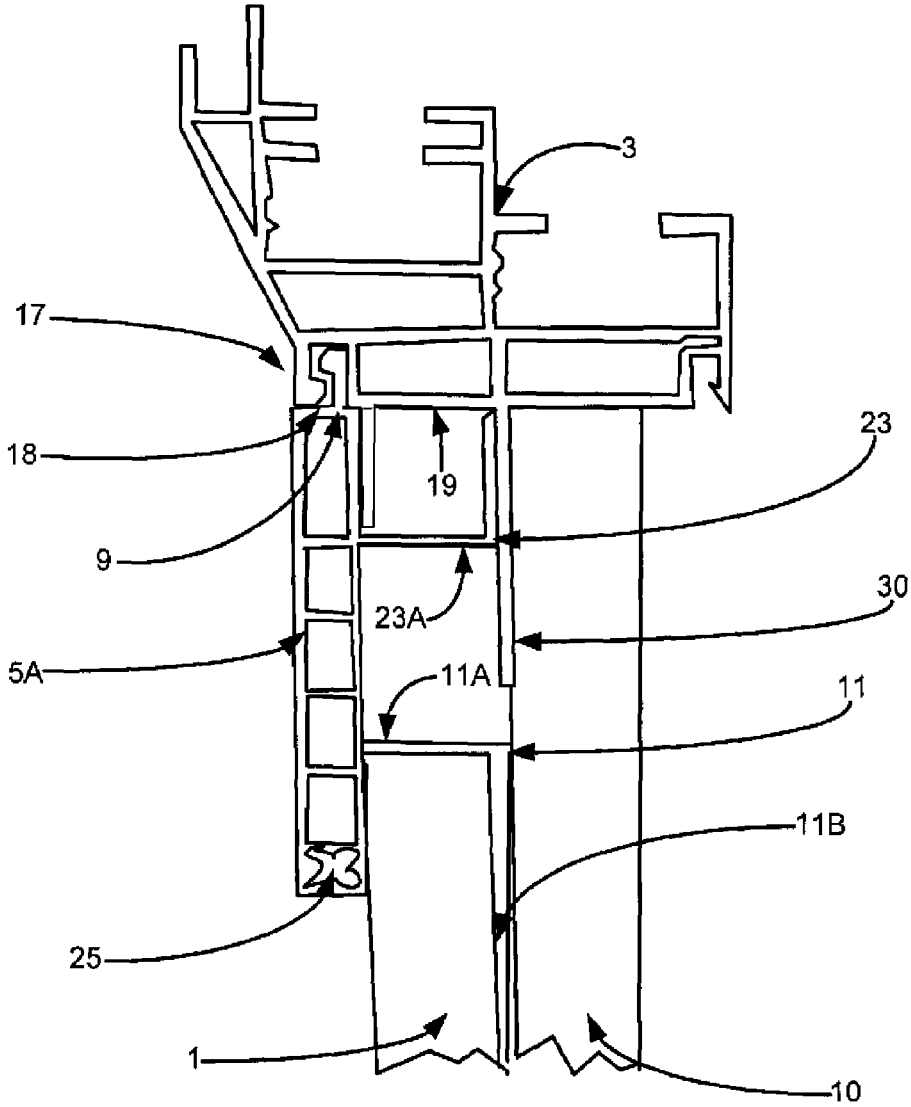
FIG. 10A is a top planar view of a side casing section mounted on the side of the window frame installed on a house showing the exterior siding, in accordance with a first embodiment.
Figure 10B:
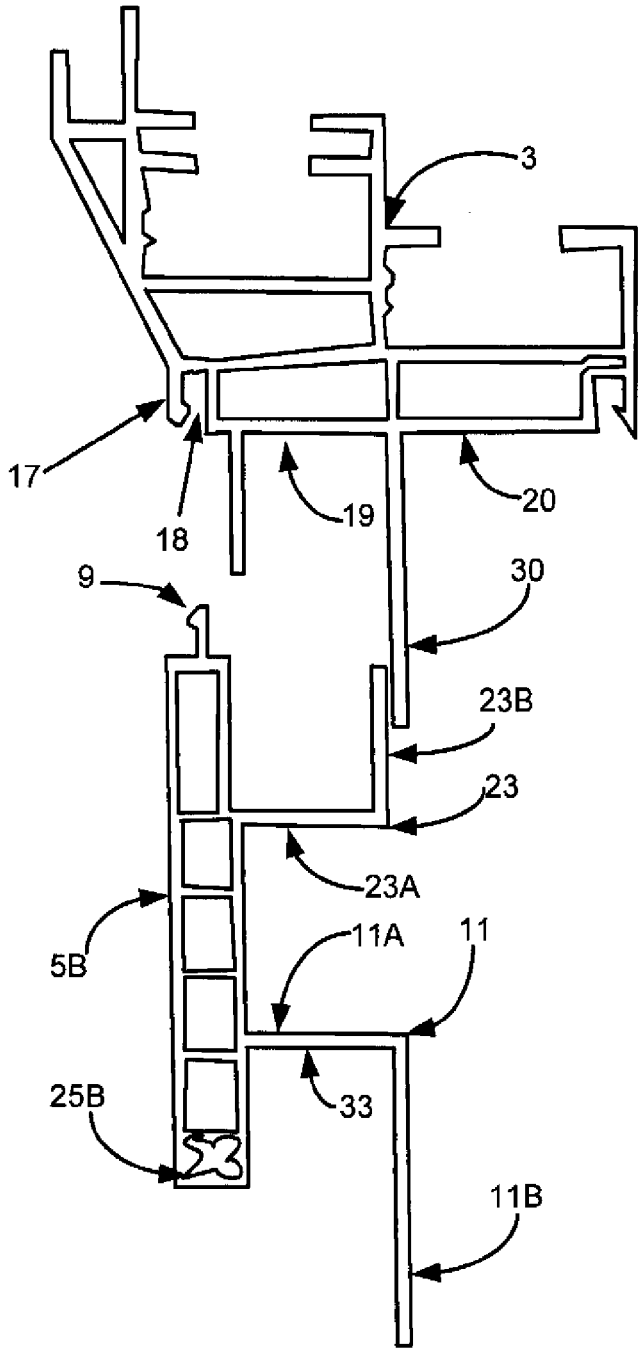
FIG. 10B is an exploded top view of a side casing section and the side of the window frame, in accordance with the first embodiment.

Referring now again to FIG. 2, nailing fins 11 are located on the outside edges of the side and top sections 5*a*, 5*b* and 5*c*. When the casing 10 has been mounted on the window, the nailing fins 11 sit flush against the sheathing or other underlayer of the house. Nails can be driven through the plurality of slotted nail holes 12 extending the length of the nailing fins to further secure the casing to the house. Along the length of the inside edges of top and side casings 5*a*, 5*b*, and 5*c* are located tongues 9 that extend in a direction perpendicular to the plane of the window or door. The tongues 9 are to be received by accessory grooves or channels 18 on a forward facing surface on the window frame 3 as shown in FIGS. 5, 10A, and 10B. Along the inside edge of the sill 6 is located a sill tongue 15 that extends in a direction perpendicular to the plane of the window. The sill tongue 15 can be received by the accessory groove or channel 18*a* in a forward facing surface on the bottom of the window frame 3 as shown in FIGS. 8A, 8B, and 9. The sill tongue 15 can have a notch or flange at its upper end to overlap a flexible locking accessory 17 in accessory groove 18*a* in the bottom of the window frame. End caps 8 can also be attached to the sill 6 to provide a finished look.

Figure 3:
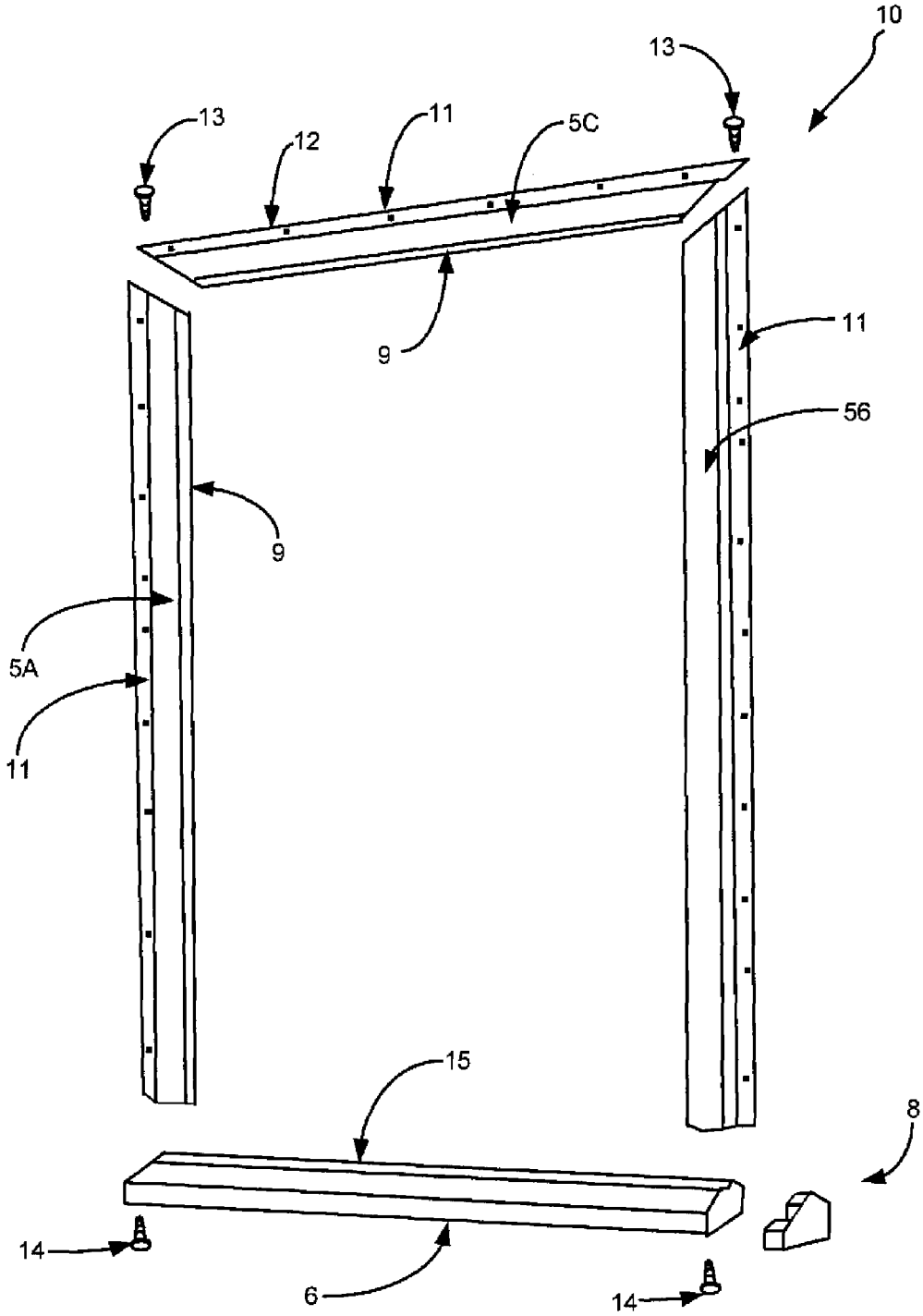
FIG. 3 is a perspective exploded view of the casing of FIG. 2.
Figure 4A:
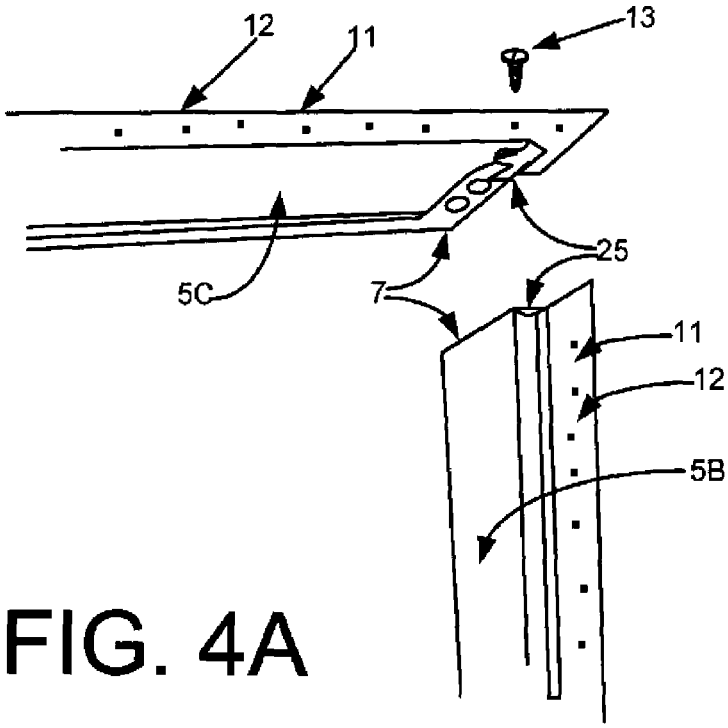
FIG. 4A is a fragmentary perspective view of the upper right corner of the casing of FIG. 3.

As seen in FIGS. 3, 4A, 4B, and 4C, a complete window casing 10 can comprise a few components and can be easily assembled and mounted on the window frame. In the first exemplary embodiment, after installing the window and window frame 3 in the house in known fashion, nails or screws can be driven through the nail slots 31 in the window nailing fin 30 into the sheathing 16 to secure the installed window as shown in FIG. 5. Then, as shown in FIGS. 3 and 4A, the pre-mitered ends 7 of side sections 5*a* and 5*b* are placed adjacent to the pre-mitered ends 7 of top casing section 5*c*. The sections 5*a*, 5*b*, and 5*c* can be attached by screws 13 inserted in the top casing. The screws 13 are attached through predrilled holes into receiving screw bosses 25 located in the side casings. The assembled sections creating a three-sided "horseshoe" shaped assembly. The horseshoe shaped assembly is then slidably mounted over the window frame 3. The tongues 9 on the inside edges of the side sections 5*a* and 5*b* can be inserted in the accessory grooves 18 of the sides of the window frame 3 as shown in FIGS. 5, 10A, and 10B. By sliding the three-sided assembly down over the front of the window frame, the tongues 9 of the side casing sections assembly fit into the accessory grooves 18 located on the sides of the window frame 3 until the tongue 9 of the top casing section 5*c* mates the accessory groove 18. The tongue 9 is seated in the accessory groove 18 of the top of the window frame.

Referring to FIGS. 10A and 10B, the casing 10 may be elongated panels mountable about the perimeter of the window frame 3 on at least three sides. The panels may have a front portion 50 having a planar front surface extending from a first edge 52 to a second edge 54 and a rear portion 56 having a rear surface. At least one rib 58 may couple the front portion 50 to the rear portion 56. The casing 10 may have at least one screw boss 25 disposed between the front portion 50 and the rear portion 56 for securing adjacent panels together. The tongue 9 may be disposed in close proximity to the first edge 52, the tongue sized to engage the groove 18 on the window frame 3.

Referring to FIGS. 8A, 8B, 9, 10A, and 10B, in accordance with the first exemplary embodiment, the tongues 9 may be disposed on the first edge 52, with the tongue 9 sized to engage the accessory groove 18 on the window frame 3. The tongues 9 may be located on a surface that is perpendicular to the plane of the window and extend in a direction parallel with the plane of the window. The tongues 9 fit within the accessory groove 18 on the window frame 3. The opening of the accessory groove 18 is located in a direction that lies in the plane of the window and is positioned to receive the tongues 9, which extend in the same direction as the opening of the accessory groove 18. The tongues 9, in accordance with the first exemplary embodiment, are not limited to being located in close proximity to the first edge 52. The tongues can be positioned on a variety of surfaces on the sill 6 and casing. The tongues 9 may also be angled or positioned to fit within accessory grooves 18 located in a variety of positions.

In the first exemplary embodiment, the nailing fin 11 of the side and top casings 5*a*, 5*b* and 5*c* is in the form of an L-shaped flange. Portion 11*a* of the flange extends generally perpendicular from the rear portion 56 of the casing approximately ¾ of an inch. The other portion 11*b* of the L-shaped nailing fin 11 extends in a direction away from the window frame 3 generally parallel with the exterior face of the casing so that a portion 11*b* of nailing fin 11 lies essentially flush with the underlayer or sheathing 16 of the house. Portion 23*a* of second L-shaped flange 23 extends generally perpendicular from the rear portion 56 of the casing approximately ¾ of an inch. The other portion 23*b* of said L-shaped flange 23 extends in a direction toward window frame 3 generally parallel with the exterior face of the casing so that a portion 23*b* of L-shaped flange lies in slot 19 essentially flush with the nailing fin 30 of the window frame providing further support for the casing on the window frame. Note that the distance "D2" from the second portion 23*b* of the second "L" shaped flange 23 to the front surface, may be less than the distance "D1" from the second portion 11*b* of the first "L" shaped flange 11 to the front surface. This allows the front surface to be parallel with the sheathing when the second portion 23*b* of the second "L" shaped flange 23 sits on the nail flange 30 of the window itself. The wall thickness of the front portion, the rear portion, and the first "L" shaped flange may be substantially uniform. The distance from the front surface to the rear surface may be at least four times greater than the wall thickness of the front portion, the rear portion, or the "L" shaped flange.

Figure 4B:
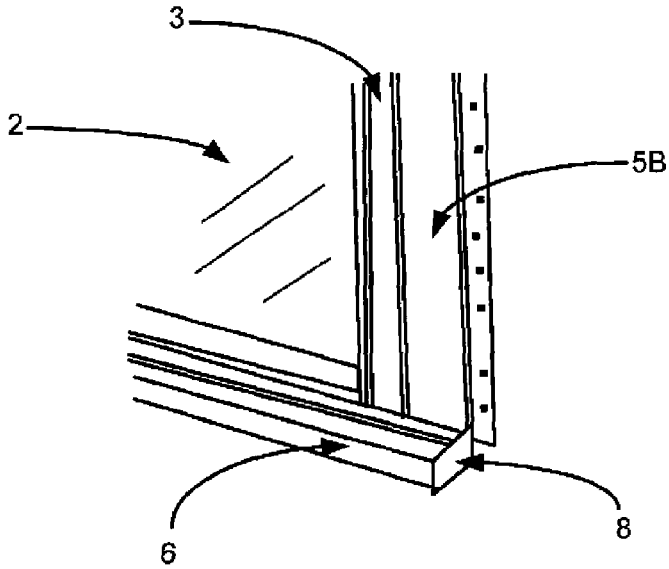
FIG. 4B is a perspective view of the lower right corner of the casing of FIG. 2.
Figure 4C:
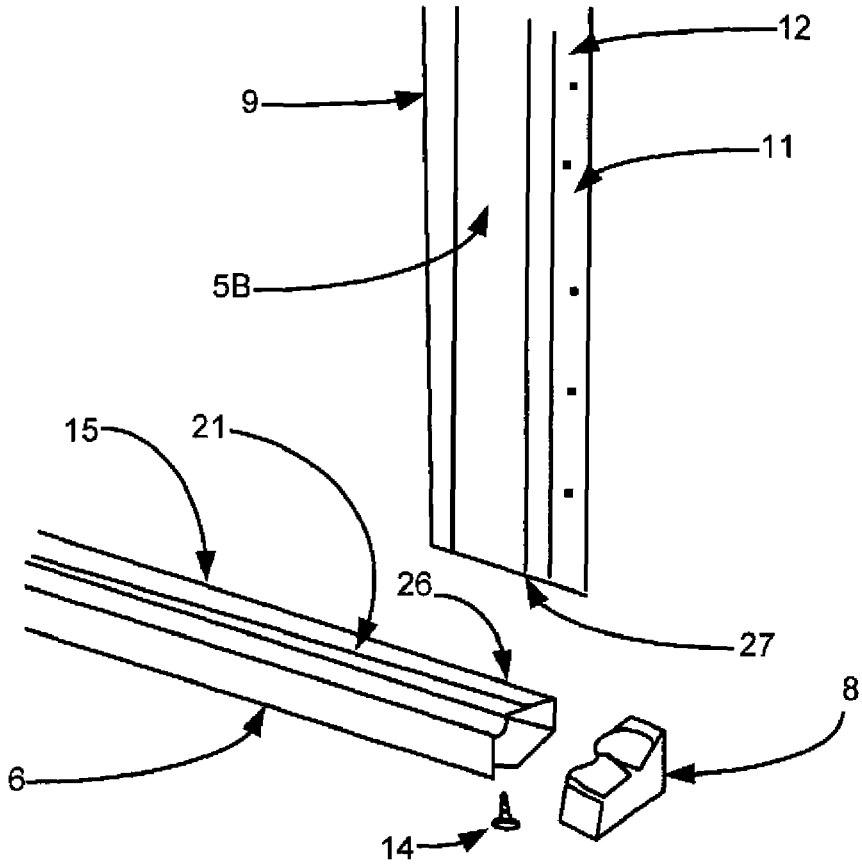
FIG. 4C is a fragmentary exploded perspective view of the lower right corner of the casing of FIG. 3.

Once the three-sided assembly is in place, one or more nails or screws can be driven through nail slots 12 in each of the nailing fins 11 to hold the three-sided assembly in place on the window frame. As shown in FIGS. 3, 4B, 4C, 8A, 8B, and 9, sill 6 is then raised upwards toward the bottom of the window frame 3 inserting the sill tongue 15 into the accessory groove 18 on the bottom of the window frame 3 and snapping it into place. The sill tongue 15 can be notched or flanged and lockingly engages flexible accessory lock 17 on the window frame. The sill tongue 15 may start a spaced distance D3 from the first end of the sill 6 to allow room for the casing 5*a* and 5*b*; the distance D3 may be equal to or greater than the width of the casing 5*a* and 5*b*. As shown in FIGS. 4B and 4C, the bottoms 27 of the side casings 5*a* and 5*b* sit flat on sill 6 at meeting places 26 behind the step 21 of the sill, which may be tapped into place with a mallet, if necessary. The step 21 extends from an upper surface 60 and may visually hide the bottom 27 of the casing 5*a* and 5*b* to compensate for inaccurate casing lengths. End caps 8 are fitted into the sides of the sill section 6. The sill 6 is then secured to the side casings 5*a* and 5*b* with screws 14 inserted in the sill and received in screw bosses 25 located in the side casings. The sill 6 can have pre-drilled holes 32 to accommodate screws 14. The completed casing 10 is then secured to the side of the house with nails, screws, or staples being driven through nail holes 12 in nailing fins 11. The siding 1 is installed on the house in known fashion. The portion of the siding that lies adjacent to the window frame and casing can be cut to fit snugly between the casing J-channel in recess 33 formed by the back of the casing and L-shaped section 11. The sill 6 may have a drip stop 62 extending from the first end to the second end along a second surface 64.

FIG. 5 shows a portion of the top and side sections of the window frame 3, nailing fin 30, and nail slots 31 for securing the window frame to the house and the accessory groove 18 for receiving tongue 9 of the window casing and flexible accessory lock 17 to lockingly engage the tongue 9. The sill tongue 15 of the sill 6 is similarly received in the accessory groove 18 of the bottom section of the casing. It will be understood that not all window frames will have accessory grooves. This particularly will be the case in older construction where the original windows and window frames are not being replaced. In order to use the casing system of the present invention with these older style windows, a prefabricated structure having an accessory groove can be installed around the periphery of the window frame to accommodate the casing. Such a device 35, as shown in FIG. 5B, is essentially a C-shaped member and includes an accessory groove 18 and J-channel 17 and may be made of materials such as extruded vinyl or aluminum, for example. The device 35 may be affixed to the window frame in a conventional manner, such as by use of nails, screws, staples or other fasteners.

Figure 6:
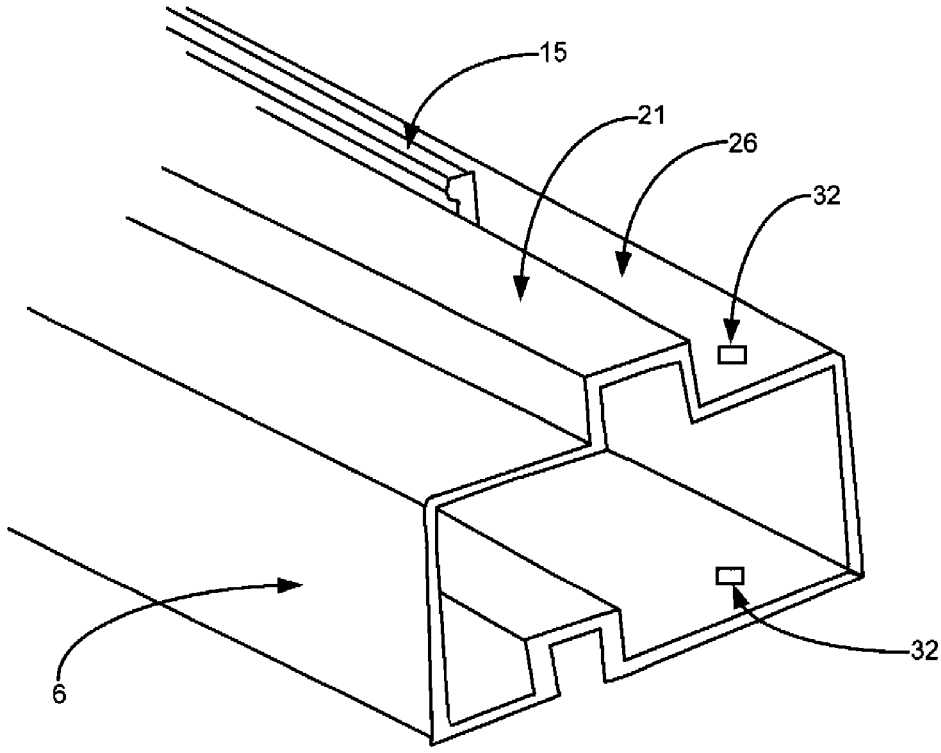
FIG. 6 is a fragmentary perspective view of a sill of the casing according to the invention.
Figure 7:
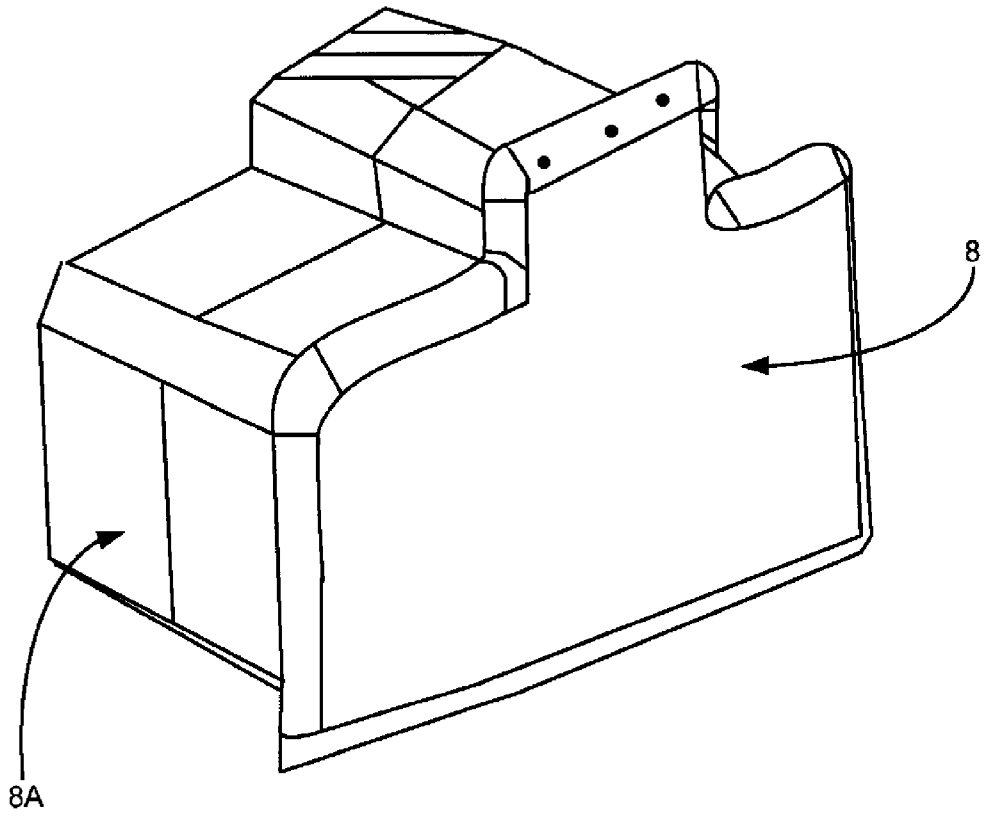
FIG. 7 is a fragmentary perspective view of an end cap of a sill of the casing according to the invention.

One side of the sill 6 and end cap 8 are shown in greater detail in FIGS. 6 and 7. The sill 6 includes a sill tongue 15, which is inserted in the accessory groove 18 of the bottom section of the window frame 3. In the first exemplary embodiment, the sill tongue 15 can have a notch or flange at one end, which lockingly engages a J-channel 17 in the the accessory groove. As can be seen in FIG. 6, sill tongue 15 is recessed inwardly from the side of the sill 6 to enable the bottom 27 of the side casing sections 5*a*, 5*b* to sit flat on the sill 6 at the meeting place 26, behind the step 21 extending upward from the sill. The meeting place 26 can be approximately the width of the side casing sections 5*a*, 5*b*, which are maintained in place between the rear side of the step 21 and the exterior of the siding 1 of the house. The end caps 8 may be made of the same material as the sill and are sized and configured to fit securely in the opposite sides of the sill section 6. Also shown in FIGS. 3, 4B, and 4C, screws 14 are inserted through pre-drilled holes 32 in the sill and pre-drilled holes 33 in the end caps and received in screw bosses 25 in the side casings 5A and 5B.

Figure 11A:
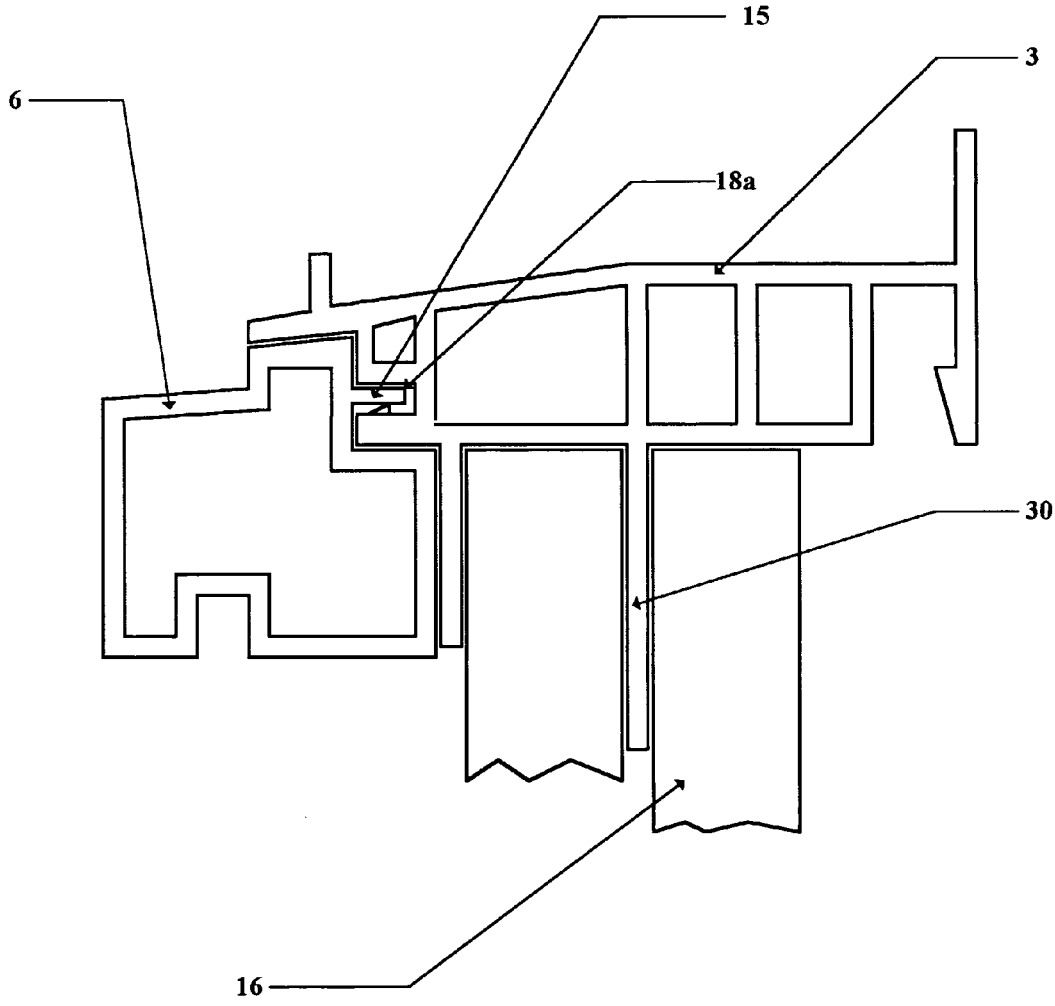
FIG. 11A is a side view of a sill mounted on the bottom of a window frame installed on a house showing the exterior siding, in accordance with a second embodiment.
Figure 11B:
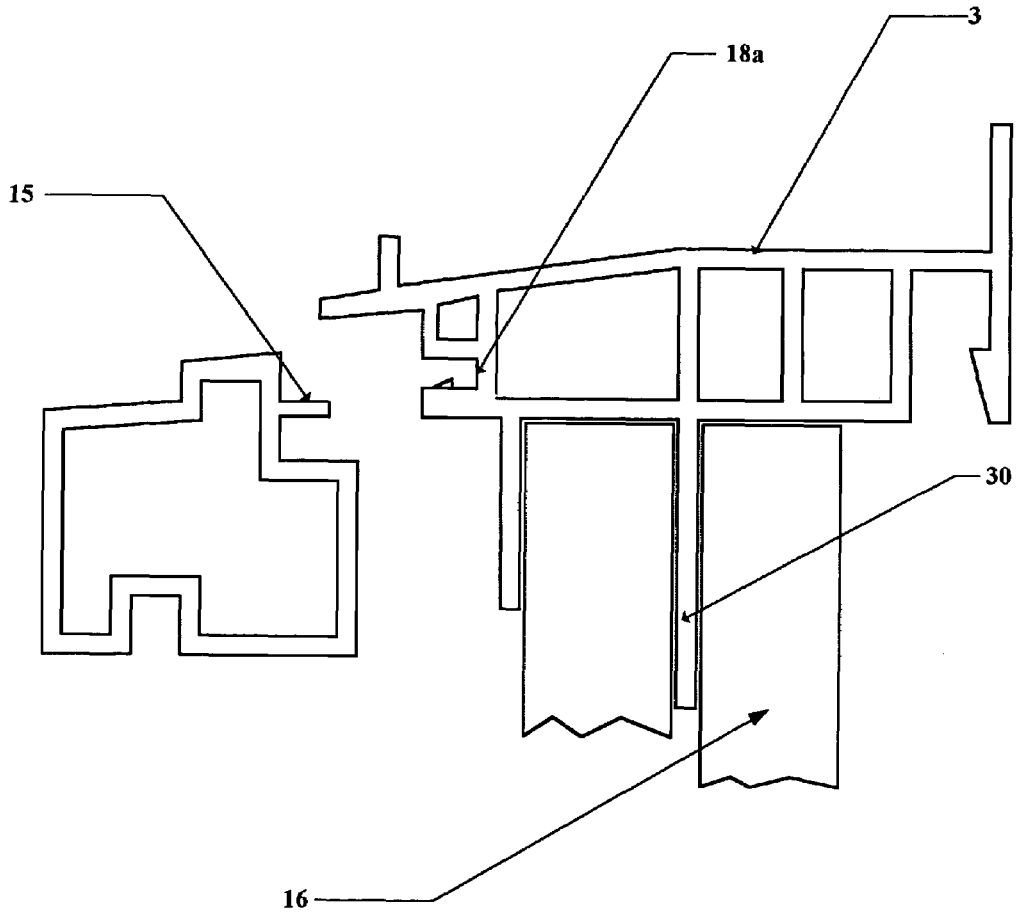
FIG. 11B is an exploded side view of a sill and the bottom of a window frame, in accordance with a second embodiment.

Referring to FIGS. 11A and 11B, the sill 6', in accordance with a second exemplary embodiment, has the silt tongue 15' extending from a rear surface of the sill 6'. The sill tongue 15' engages the accessory groove 18*a'* in the window frame 3'. The sill tongue 15' may be located on a surface that is parallel to the plane of the window and extends in a direction perpendicular with the plane of the window. The sill tongue 15' fits within the accessory groove 18' on the window frame 3'. The opening of the accessory groove 18' is located in a direction that is perpendicular to the plane of the window and positioned to receive the sill tongue 15', which extends in the same direction as the opening of the accessory groove 18'. The sill tongue 15', in accordance with the second exemplary embodiment, is not limited to being located on a rear surface of the sill 6'. The sill tongue 15' can be positioned on a variety of surfaces on the sill 6', for example, but not limited to, the sill tongue 15' may extend from the top of the sill 6' and extend parallel with the top surface of the sill 6' (not shown). The sill tongue 15' may also be angled or positioned to fit within the accessory grooves 18' located in a variety of positions.

Figure 12A:
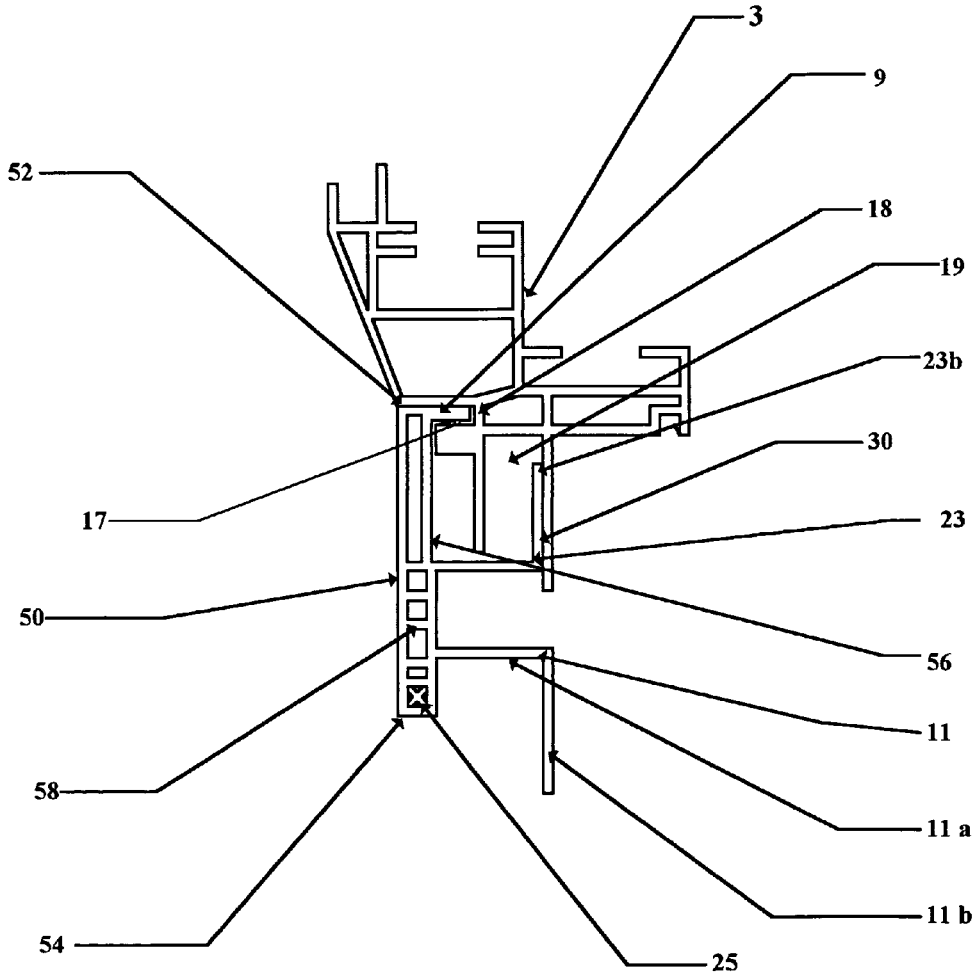
FIG. 12A is a top planar view of a side casing section mounted on the side of the window frame installed on a house showing the exterior siding, in accordance with a second embodiment.
Figure 12B:
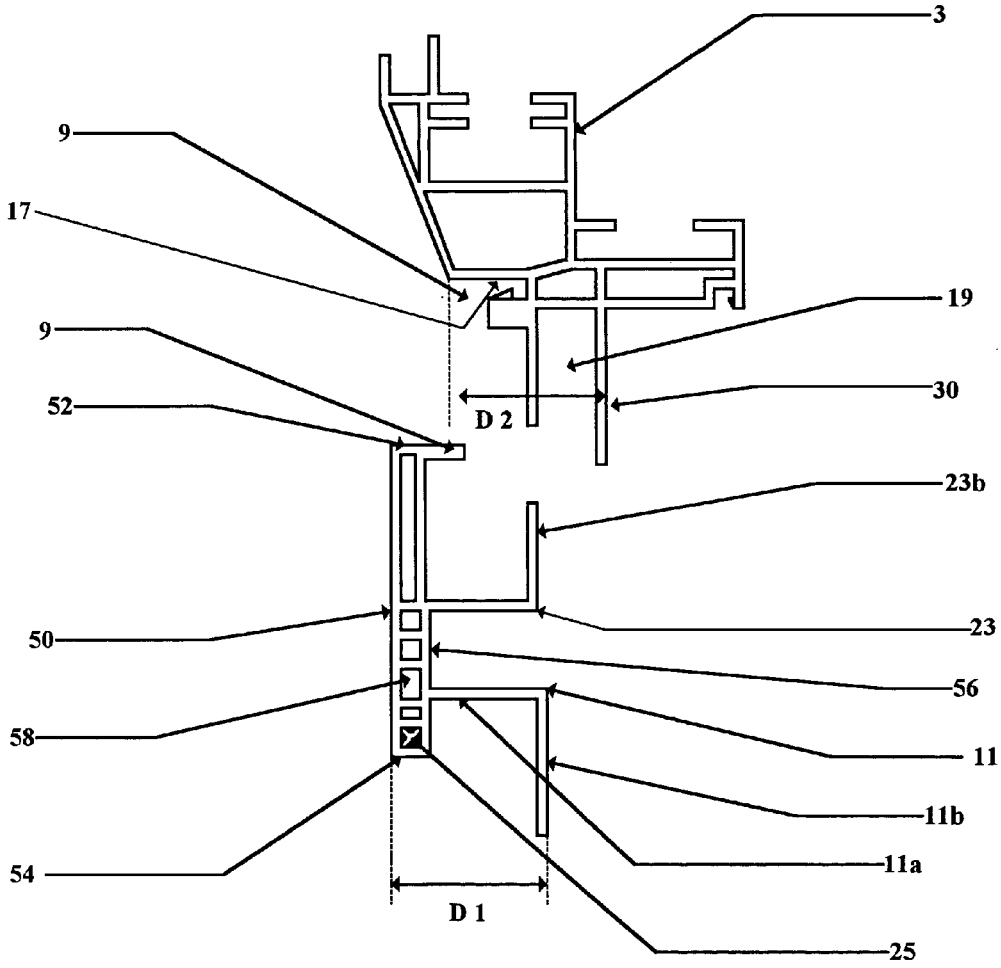
FIG. 12B is an exploded top view of a side casing section and the side of the window frame, in accordance with a second embodiment.

Referring to FIGS. 12A and 12B, in accordance with the second exemplary embodiment, the elongated panels of the casing 10 may be mountable about the perimeter of the window frame 3" on at least three sides. The panels may have a front portion 50" having a planar front surface extending from a first edge 52" to a second edge 54" and a rear portion 56" having a rear surface. At least one rib 58" may couple the front portion 50" to the rear portion 56". The casing 10 may have at least one screw boss 25" disposed between the front portion 50" and the rear portion 56" for securing adjacent panels together. The tongues 9" are sized to engage the groove 18" on the window frame 3". The tongues 9" extend from a rear portion 56" on the casing. The tongues 9" engage the accessory groove 18" in the window frame 3". The tongues 9"may be located on a surface that is parallel to the plane of the window and extend in a direction perpendicular with the plane of the window. The tongues 9" fit within the accessory groove 18" on the window frame 3". The opening of the accessory groove 18" can be located in a direction that is perpendicular to the plane of the window and positioned to receive the tongues 9", which extend in the same direction as the opening of the accessory groove 18". The tongues 9", in accordance with the second exemplary embodiment, are not limited to being located on the rear portion 56" of the casing. The tongues 9" can be positioned on a variety of surfaces on the casing, for example, but not limited to, the tongues 9" may extend from the first edge 52" or second edge 54" of the casing and extend parallel with the top edge 52" of the casing (this example not shown in figures). The tongues 9" may also be angled or positioned to fit within accessory grooves 18" located in a variety of positions.

Figure 13A:
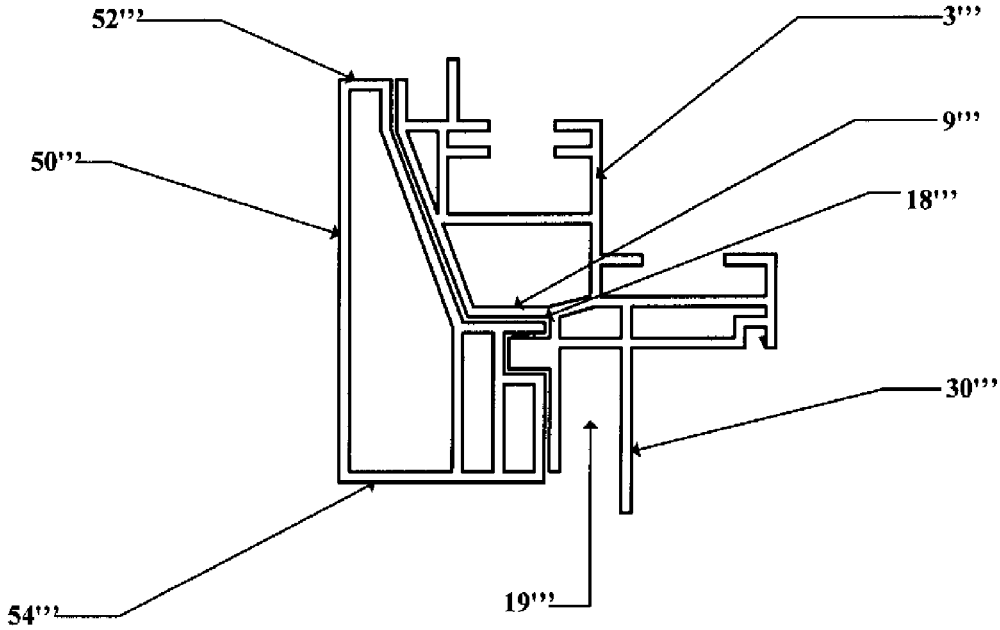
FIG. 13A is a top planar view of a second example of the side casing section mounted on the side of the window frame installed on a house showing the exterior siding, in accordance with a second embodiment.
Figure 13B:
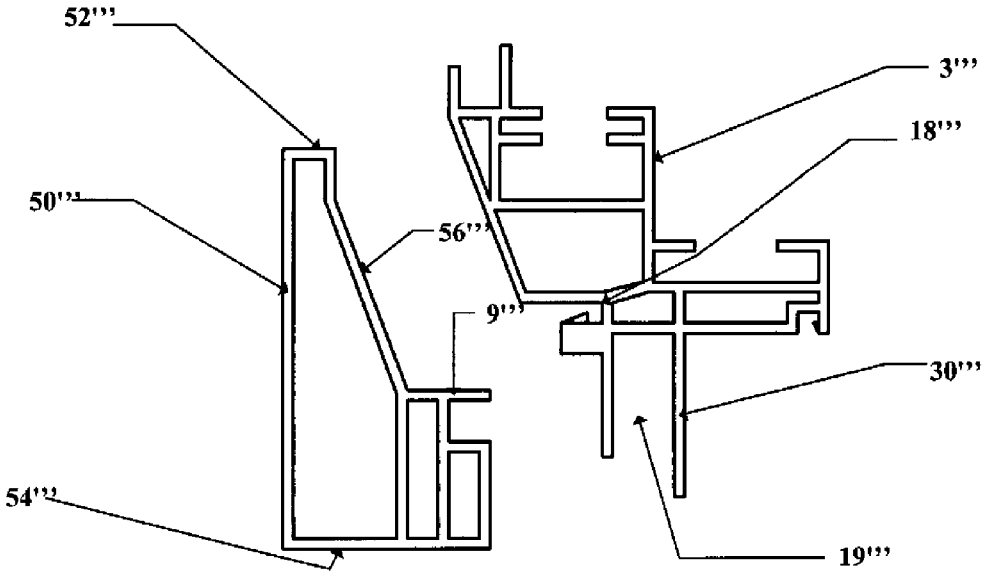
FIG. 13B is an exploded side view of a second example of the side casing section mounted on the side of the window frame installed on a house showing the exterior siding, in accordance with a second embodiment.

FIGS. 13A and 13B are top plan views of a second example of the side casing section mounted on the side of the window frame installed on a house showing the exterior siding, in accordance with the second exemplary embodiment. The second example of the side casing does not have any L-shaped flanges extending from the rear portion 56'''. The second example of the side casing couples to the window frame 3''' by the tongues 9''' and accessory groove 18'''. In addition to the tongues 9''', glue, adhesive tape, or additional clips can be used to couple the casing to the window frame 3'''. The additional clips may be lips on the first edge, second edge, or both. The casing of the second example can be coupled to the window casing using a similar method as described in the first example of the side panels. The second example of the side casing may also have mitered ends on the panels and screw bosses (not shown) to allow the side panels to couple to adjoining panels, as discussed in the first example.

In accordance with the second example of the side casing, the tongues 9''' are sized to engage the groove 18''' on the window frame 3'''. The tongues 9''' extend from a rear portion 56''' on the casing. The tongues 9''' engage the accessory groove 18''' in the window frame 3'''. The tongues 9''' may be located on a surface that is parallel to the plane of the window and extend in a direction perpendicular with the plane of the window. The tongues 9''' fit within the accessory groove 18''' on the window frame 3'''. The opening of the accessory groove 18''' can be located in a direction that is perpendicular to the plane of the window and positioned to receive the tongues 9''', which extend in the same direction as the opening of the accessory groove 18'''. The tongues 9''', in accordance with the second embodiment, are not limited to being located on the rear portion 56''' of the casing. The tongues 9''' can be positioned on a variety of surfaces on the casing, for example but not limited to, the tongues 9''' may extend from the first edge 52''' or second edge 54''' of the casing and extend parallel with the top edge 52''' of the casing (this example not shown in figures). The tongues 9''' may also be angled or positioned to fit within accessory grooves 18''' located in a variety of positions.

In addition to utilizing the casing as described in connection with windows, the casing of the present invention may be used in connection with doors, passageways, or any other type of opening in a structure. Further, the casing system of the present invention is not limited to four-sided openings, and may be utilized in archways calling for a curved trim, a one-piece ornamental header, a multi-sided window or other structure, and may be prefabricated or cut at the site.

It should be emphasized that the above-described embodiments of the present invention exemplary embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A window casing kit for a window frame, comprising:

a plurality of coupled elongated panels mountable about a perimeter of the window frame on at least three sides, said panels having a front portion having a planar front surface extending from a first edge to a second edge, a rear portion having a rear surface, a tongue extending in a direction about perpendicular to the planar front surface, the tongue engaged to a perimeter groove on the window frame, a first "L" shaped flange, a first portion of the first "L" shaped flange extending from the rear surface a spaced distance from the second edge and a second portion of the first "L" shaped flange extending generally parallel to the planar front surface away from the window frame, the first portion of the "L" shaped flange, the second portion of the first "L" shaped flange, and the rear surface forming a channel sized to accept siding, and wherein the second portion of the first "L" shaped flange has a plurality of spaced nail slots.

2. The window casing kit of claim 1, further comprising at least one rib coupling the front portion to the rear portion.

3. The window casing kit of claim 1, wherein at least one end of each of the coupled elongated panels is mitered.

4. The window casing kit of claim 1, further comprising a second "L" shaped flange, a first portion of the second "L" shaped flange extending from the rear surface a spaced distance from the second edge and a second portion of the second "L" shaped flange extending generally parallel to the front surface towards the first edge.

5. The window casing kit of claim 4, wherein the distance from the second portion of the second "L" shaped flange to the front surface is less than the distance from the second portion of the first "L" shaped flange to the front surface.

6. The window casing kit of claim 1, wherein the back portion is connected to the front portion by two ribs, wherein one of the ribs is at the second edge, and wherein neither of the two ribs is at the first edge.

7. The window casing kit of claim 1, wherein the coupled elongated panels are extruded.

8. The window casing kit of claim 1, wherein the coupled elongated panels are extruded vinyl.

9. The window casing kit of claim 1, wherein the wall thickness of the front portion, the rear portion, and the first "L" shaped flange are substantially uniform.

10. The window casing kit of claim 1, wherein each of the coupled elongated panel further comprises a third portion substantially planar with the second portion of the first "L" shaped flange, wherein the third portion is flush with a front of the window frame and parallel with the planar front portion.

11. The window casing kit of claim 1, further comprising a sill nose, the sill nose having a tongue extending in a direction about perpendicular to the front surface of the panels sized to be received by an accessory groove near a bottom of the window frame.

12. The window casing kit of claim 1, wherein the tongue has a notch at one end that overlaps a locking accessory in the accessory groove near the bottom of the window frame.

13. The window casing kit of claim 11 wherein the tongue extends along a longitudinal axis of the sill nose starting a spaced distance from an end of the sill nose, the spaced distance is equal to or greater than a width of the planar front surface.

14. A window assembly, comprising:

a sash;

a frame surrounding the sash on at least three sides, the frame having a perimeter groove; and a trim kit comprising a plurality of coupled elongated panels mountable about the perimeter of the frame on at least three sides, said panels having a front portion having a planar front surface extending from a first edge to a second edge, a rear portion having a rear surface, a tongue extending in a direction about perpendicular to the front surface, the tongue sized to engage the perimeter groove on the window frame, a first "L" shaped flange, a first portion of the first "L" shaped flange extending from the rear surface a spaced distance from the second edge and a second portion of the first "L" shaped flange extending generally parallel to the front surface away from the window frame, the first portion of the "L" shaped flange, the second portion of the first "L" shaped flange, and the rear surface of the panel forming a channel sized to accept siding, and wherein the second portion of the first "L" shaped flange has a plurality of spaced nail slots.

15. The window assembly of claim 14, further comprising at least one rib coupling the front portion to the rear portion.

16. The window assembly of claim 14, wherein at least one end of each elongated panel is mitered.

17. The window assembly of claim 14, further comprising a second "L" shaped flange, a first portion of the second "L" shaped flange extending from the rear surface a spaced distance from the second edge and a second portion of the second "L" shaped flange extending generally parallel to the front surface towards the first edge.

18. The window assembly of claim 17, wherein the distance from the second portion of the second "L" shaped flange to the front surface is less than the distance from the second portion of the first "L" shaped flange to the front surface.

19. The window assembly of claim 14, wherein the tongue extends from the first edge.

20. The window assembly of claim 14, wherein the elongated panels are extruded.

21. The window assembly of claim 14, wherein the elongated panels are extruded vinyl.

22. The window assembly of claim 14, wherein the wall thickness of the front portion, the rear portion, and the first "L" shaped flange are substantially uniform.

23. The window assembly of claim 14, further comprising a sill nose, the sill nose having a tongue extending in a direction about perpendicular to the front surface of the panels sized to be received by an accessory groove along a bottom of the window frame.

24. The window casing kit of claim 23, wherein the tongue extends along a longitudinal axis of the sill nose starting a spaced distance from an end of the sill nose, the spaced distance is equal to or greater than a width of the front planar surface.

25. The window assembly of claim 14, wherein the tongue has a notch at one end that overlaps a locking accessory in the accessory groove along the bottom of the window frame.

26. A window assembly, comprising:

a sash;

a frame surrounding the sash on at least three sides; and a trim kit comprising a plurality of coupled elongated panels mountable about the perimeter of the frame on at least three sides, said panels having a front portion having a planar front surface extending from a first edge to a second edge, a rear portion having a rear surface, an adhesive applied proximate to the first edge, the adhesive bonding the panels to the frame, a first "L" shaped flange, a first portion of the first "L" shaped flange extending from the rear surface a spaced distance from the second edge and a second portion of the first "L" shaped flange extending generally parallel to the front surface away from the window frame, the first portion of the "L" shaped flange, the second portion of the first "L" shaped flange, and the rear surface of the panel forming a channel sized to accept siding, and wherein the second portion of the first "L" shaped flange has a plurality of spaced nail slots.

* * * * *